US007318706B2

(12) United States Patent
Schofield et al.

(10) Patent No.: US 7,318,706 B2
(45) Date of Patent: Jan. 15, 2008

(54) VALVING FOR MULTI-STAGE VACUUM PUMPS

(75) Inventors: Nigel Paul Schofield, Horsham (GB); Howard Brian James Stone, Horsham (GB)

(73) Assignee: Edwards Limited, Crawley, West Sussex (GB)

( * ) Notice: Subject to any disclaimer, the term of this patent is extended or adjusted under 35 U.S.C. 154(b) by 580 days.

(21) Appl. No.: 10/920,674

(22) Filed: Aug. 18, 2004

(65) Prior Publication Data

US 2005/0058552 A1 Mar. 17, 2005

(30) Foreign Application Priority Data

Sep. 15, 2003 (GB) ..... 0321576.1

(51) Int. Cl.
*F04B 25/02* (2006.01)

(52) U.S. Cl. ..... 417/266; 417/517; 417/539

(58) Field of Classification Search ..... 417/254, 417/266, 516, 517, 531, 539
See application file for complete search history.

(56) References Cited

U.S. PATENT DOCUMENTS

| | | | | |
|---|---|---|---|---|
| 772,266 | A * | 10/1904 | Alley | 417/254 |
| 1,057,135 | A * | 3/1913 | Fairhurst | 417/254 |
| 3,098,480 | A * | 7/1963 | Worthington | 417/517 |
| 3,386,384 | A * | 6/1968 | Potts | 417/539 |
| 3,791,780 | A | 2/1974 | Fritch et al. | |
| 4,102,608 | A | 7/1978 | Balkau et al. | |
| 4,370,103 | A | 1/1983 | Tripp | |
| 4,699,572 | A * | 10/1987 | Balkau et al. | 417/254 |
| 4,954,047 | A | 9/1990 | Okuyama et al. | |
| 5,540,562 | A * | 7/1996 | Giter | 417/254 |

FOREIGN PATENT DOCUMENTS

| | | |
|---|---|---|
| EP | 0 272 137 A3 | 6/1988 |
| GB | 1 413 998 A | 11/1975 |
| GB | 2 162 590 A | 2/1986 |

OTHER PUBLICATIONS

European Search Report of Application No. 04 25 5438; Date of completion of search: Aug. 9, 2005.
UK Patent Office Search Report for Application No. GB 0321576.1; Date of search: Jan. 23, 2004.

* cited by examiner

*Primary Examiner*—Michael Koczo, Jr.
(74) *Attorney, Agent, or Firm*—Ira Lee Zebrak

(57) ABSTRACT

A multi-stage vacuum pump comprises a first piston in a first cylinder defining a first stage pumping chamber and a second piston in a second cylinder defining a second stage pumping chamber. The pump has a spool valve between the first and second cylinders for controlling flow from the first stage pumping chamber to the second stage pumping chamber. Either the first cylinder and the first piston or the second cylinder and the second piston being stepped so as to define a third stage pumping chamber. The spool valve is arranged to control the flow from the second stage pumping chamber to the third stage pumping chamber.

20 Claims, 2 Drawing Sheets

VALVING FOR MULTI-STAGE VACUUM PUMPS

FIELD OF THE INVENTION

The invention relates to valving for multi-stage vacuum pumps and more particularly to valving for multi-stage dry vacuum pumps.

BACKGROUND OF THE INVENTION

Piston pumps are ideal for dry vacuum pumps as they are relatively easy to seal with contacting PTFE seals. The stages in these pumps are typically valved with reed valves or similar non-return valves. This limits the performance of such pumps to a few mbar as lower pressure forces are insufficient to actuate the reeds. Some pumps have used a striker to physically knock the reed valve open. An alternative approach has been to have ports in the cylinder walls that are opened and closed as the cylinder reciprocates. However, none of these approaches is ideal.

SUMMARY OF THE INVENTION

In accordance with one aspect of the present invention, a multi-stage vacuum pump is provided comprising a first piston in a first cylinder defining a first stage pumping chamber, a second piston in a second cylinder defining a second stage pumping chamber, a spool valve for controlling flow from the first stage pumping chamber to the second stage pumping chamber, wherein the first cylinder and the first piston are stepped so as to define a third stage pumping chamber, the spool valve being arranged to control flow from the second stage pumping chamber to the third stage pumping chamber.

In accordance with another aspect of the invention, a multi-stage vacuum pump is provided comprising a first piston in a first cylinder defining a first stage pumping chamber, a second piston in a second cylinder defining a second stage pumping chamber, a spool valve for controlling flow from the first stage pumping chamber to the second stage pumping chamber, a third stage pumping chamber downstream of the second stage pumping chamber, and a pressure actuated valve for controlling flow between the second stage pumping chamber and the third stage pumping chamber.

In accordance with yet another aspect of the invention, a multi-stage reciprocating piston vacuum pump is provided having at least a first stage, a second stage and a third stage, and spool valve means arranged to control flow from the first stage to the second stage, and from the second stage to the third stage.

BRIEF DESCRIPTION OF THE DRAWINGS

Referring to FIGS. 1 and 2, a four-stage dry vacuum pump 10 comprises a casing 12 that houses a cylinder block 13. The cylinder block 13 defines two side-by-side stepped cylinder bores 14, 16. Respective stepped pistons 18, 20 are housed in the cylinder bores 14, 16 and are connected by respective connecting rods 22 to a crankshaft 24. The crankshaft 24 is driven by an electric motor 26, which may be housed within the casing 12 or bolted to the exterior thereof.

Figure 1:
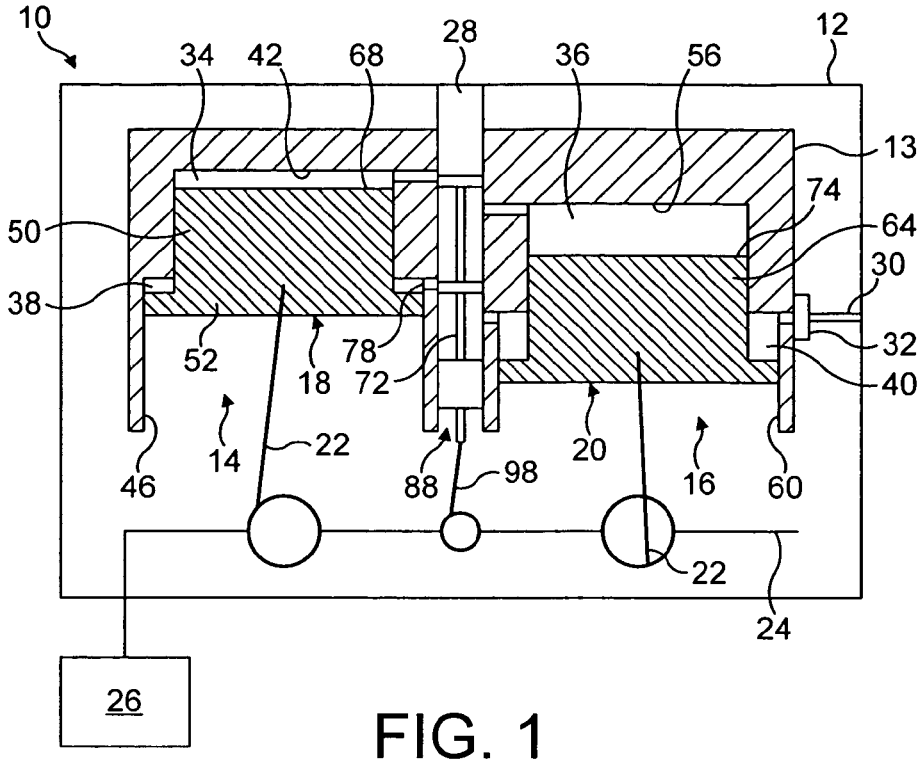
FIG. 1 is a schematic representation of a multi-stage dry vacuum pump having four pumping stages.
Figure 2:
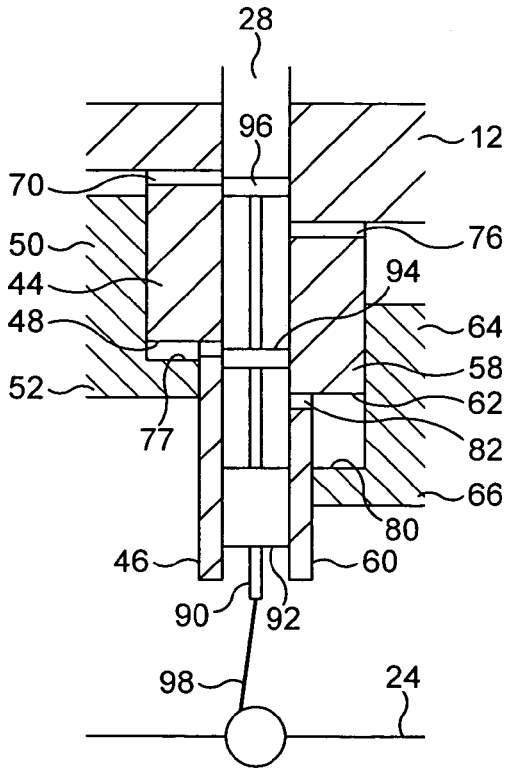
FIG. 2 is an enlarged view of the central portion of FIG. 1.

Casing 12 has an inlet port 28 and an exhaust port 30. Exhaust port 30 is closed by a non-return valve 32, which may be of any suitable design, such as a conventional reed valve. Although not shown, the pump may be provided with any suitable connection devices to permit the inlet and outlet ports 28, 30 to be connected to apparatus upstream and downstream of the pump as is required for the use to which the pump is intended.

Cylinder bores 14, 16 and pistons 18, 20 are stepped so as to define four pumping chambers 34, 36, 38, 40 that are valved to provide four pumping stages.

Cylinder bore 14 includes an upper cylinder portion defined by a top wall 42 of the cylinder block 13 and an upper cylindrical side wall 44 that extends downwardly from the top wall and a lower cylinder portion defined by a lower cylindrical side wall 46 and a lateral wall 48 that extends perpendicular to the side walls 44, 46 and interconnects the lower end of the side wall 44 and the upper end of the side wall 46. Piston 18 has an upper portion 50 sized to be slideably received in the upper cylinder portion and a larger diameter lower portion 52 sized to be a sliding fit in the lower cylinder portion. Respective seals (not shown) are provided between the upper piston portion 50 of the piston and the upper cylinder side wall 44 and the lower piston portion 52 and the lower side wall 46. These seals may be of any suitable conventional design and may, for example, be PTFE seals.

Similarly, cylinder bore 16 includes an upper cylinder portion defined by a top wall 56 of cylinder block 13 and an upper cylindrical side wall 58 that extends downwardly from the top wall and a lower cylinder portion defined by a lower cylindrical side wall 60 and a lateral wall 62 that extends perpendicular to the side walls 58, 60 and interconnects the lower end of side wall 58 and the upper end of side wall 60. Piston 20 has an upper portion 64 sized to be slideably received in the upper cylinder portion and a larger diameter lower portion 66 sized to be a sliding fit in the lower cylinder portion. Respective seals (not shown) are provided between upper portion 64 of the piston 20 and upper cylindrical sidewall 58 and lower piston portion 66 and lower side wall 60. These seals may be of any suitable conventional design and may, for example, be PTFE seals.

Pumping chamber 34 is defined between a crown 68 of piston 18 and top wall 42 and upper cylindrical side wall 44 of the upper cylinder portion of cylinder bore 14. A side entry port 70 defined in upper cylindrical side wall 44 connects pumping chamber 34 with a valve bore 72 extending between and parallel to cylinder bores 14, 16. The upper end of valve bore 72 defines the pump inlet port 28.

Pumping chamber 36 is defined between a crown 74 of piston 20 and top wall 56 and upper cylindrical wall 58 of cylinder bore 16. A side entry port 76 defined in upper cylindrical wall 58 adjacent top wall 56 connects pumping chamber 36 with valve bore 72.

Pumping chamber 38 is defined between an upwardly facing annular wall 77 of lower portion 52 of piston 18, lateral wall 48, lower cylindrical wall 46 and the circumferentially extending sidewall of the upper piston portion 50. A side entry port 78 defined in lower cylindrical side wall 46 adjacent lateral wall 48 connects pumping chamber 38 with valve bore 72.

Pumping chamber 40 is defined between an upwardly facing annular wall 80 of lower portion 66 of piston 20, lateral wall 62, lower cylindrical side wall 60 of cylinder bore 16, and the circumferentially extending sidewall of upper piston portion 64. A side entry port 82 defined in lower cylindrical side wall 60 connects pumping chamber 40 with valve bore 72.

Valve bore 72 houses a spool 88 comprising a valve rod 90 and three disc-like islands 92, 94, 96. Valve rod 90 extends axially in valve bore 72 and is connected by a connecting rod 98 to crankshaft 24. Islands 92, 94, 96 are sized so as to be a close sliding fit in valve bore 72 and are spaced apart along the length of the valve rod. Spool 88 is connected with the crankshaft 24 so that it reciprocates 90° out of phase with the two pistons 18, 20 and which together with the positioned side entry ports 70, 76, 78, 82 and islands 92, 94, 96, enables the gas received at the pump inlet 28 to pass sequentially from pumping chamber 34 (first stage) to pumping chamber 36 (second stage), from pumping chamber 36 to pumping chamber 38 (third stage), and from pumping chamber 38 to pumping chamber 40 (fourth stage), thus providing a four-stage pumping process. The pumped gas in final stage pumping chamber 40 is released through exhaust port 30 via non-return valve 32.

It will be appreciated that because spool 88 is positively driven by the crankshaft 24, it is therefore less susceptible to sticking and leakage than conventional interstage valving that is actuated by the gas pressure. By providing a positive drive, the pump can operate at lower pressures since gas pressure is not required to actuate the valve. Furthermore, valve losses between the stages can be minimised, since it can be ensured that the valve ports are fully opened and the timing of the valve opening can be optimised.

It will be understood that the pistons and cylinders can comprise more than one step so as to provide three or more pumping stages per cylinder/piston combination. Alternatively, a stepped piston can be provided next to a non-stepped piston to provide a three stage pump.

It will be understood that having the first and second stage pumping chambers 34, 36 disposed above the third and fourth stage pumping chambers 38, 40 provides the advantage that their seals are isolated from atmospheric pressure by the seals of the third and fourth stage pumping chambers. This reduces the likelihood of leakage and improves pump efficiency.

Although spool 88 is shown being driven from crankshaft 24 via a direct connection in the form of connecting rod 98, alternative driving means for the spool could be provided. For example, the spool valve could be driven against a biasing spring arrangement by a cam actuated by a take-off drive from the crankshaft. Another alternative would be to use a scotch yolk mechanism. This provides certain advantages over a simple connecting rod or a cam mechanism. Specifically, a scotch yolk mechanism provides a true simple harmonic action, reduced out of balance forces and negligible radial force, and should increase the life of the spool seals.

Although exhaust port 30 is closed by a conventional reed valve, it will be understood that as an alternative, an exhaust port arrangement may be provided whereby the exhaust is controlled by spool 88.

It will be understood that more than two cylinders can be grouped around a spool so that the spool could valve a pump having at least three cylinders.

Figure 3:
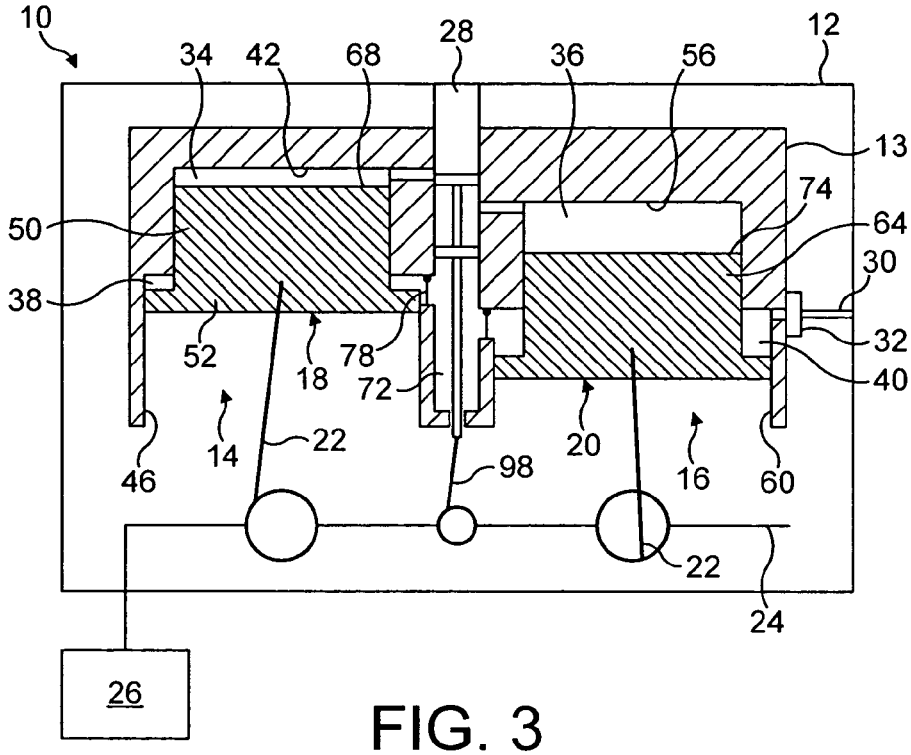
FIG. 3 is a schematic representation of a pump implementing a combination of a spool valve and flap valves.
Figure 4:
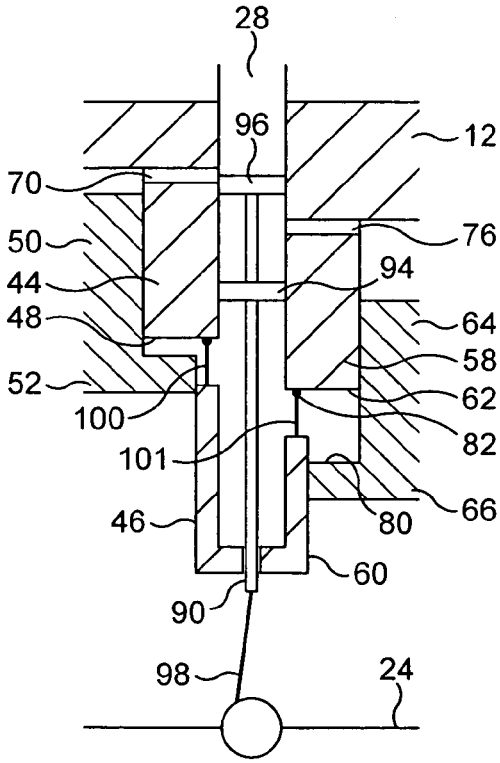
FIG. 4 is an enlargement of the central portion of FIG. 3.

Spool control of the flow between each stage may not always be desirable. Referring to FIGS. 3 and 4, spool control between the first and second stages is provided when the pressure is low and reed or flap valves (100, 101) of different opening resistances are used for subsequent (further) stages when the pressure will be sufficient to reliably actuate such valves.

The present invention provides an improved, low cost pump having a preferred range of capacities between 0.5 and 5 $m^3$/hr, capable of backing small turbo pumps, and a more reliable alternative to diaphragm pumps typically used for backing turbo pumps.

In the description, reference has been made to pumping a gas. It is to be understood that the pump may be used to pump vapours and gas/vapour mixtures as well.

While the foregoing description and drawings represent the preferred embodiments of the present invention, it will be apparent to those skilled in the art that various changes and modifications may be made therein without departing from the true spirit and scope of the present invention.

The invention claimed is:

1. A multi-stage vacuum pump comprising: a first piston in a first cylinder defining a first stage pumping chamber; a second piston in a second cylinder defining a second stage pumping chamber; a spool valve for controlling flow from the first stage pumping chamber to the second stage pumping chamber; and wherein the first cylinder and the first piston are stepped so as to define a third stage pumping chamber, the spool valve being arranged to control flow from the second stage pumping chamber to the third stage pumping chamber.

2. The pump as claimed in claim 1 wherein the second piston and the second chamber are stepped so as to define a fourth stage pumping chamber, the spool valve being arranged to control flow sequentially from the first stage pumping chamber to the fourth stage pumping chamber.

3. The pump according to claim 2 wherein the first stage pumping chamber is disposed between a top wall of the first cylinder and a crown of the piston, the second stage pumping chamber is disposed between a top wall of the second cylinder and a crown of the second piston, the third stage pumping chamber is disposed below the first stage pumping chamber, and the fourth stage pumping chamber is disposed below the second stage pumping chamber.

4. The pump according to claim 1 wherein the spool valve is disposed between the first cylinder and the second cylinder.

5. The pump according to claim 4 wherein the spool valve comprises a passage extending between the first cylinder and the second cylinder in a lengthwise direction thereof, and further including a rod carrying a plurality of islands arranged for reciprocation in the passage, and each pumping chamber having a port leading to the passage.

6. The pump according to claim 5 wherein the first cylinder and the second cylinder and the passage are parallel.

7. The pump according to claim 5 further including a crankshaft and wherein the first piston and the second piston are adapted to be driven by the crankshaft and wherein the spool valve rod and the crankshaft are connected.

8. The pump according to claim 5 wherein the spool valve rod is adapted to reciprocate out of phase with the first piston and the second piston.

9. The pump according to claim 1 wherein the spool valve is adapted to form an exhaust port of the pump for controlling flow through the exhaust port.

10. A multi-stage vacuum pump comprising: a first piston in a first cylinder defining a first stage pumping chamber; a second piston in a second cylinder defining a second stage pumping chamber; a spool valve for controlling flow from the first stage pumping chamber to the second stage pumping chamber; a third stage pumping chamber downstream of the second stage pumping chamber; and a first pressure actuated valve for controlling flow between the second stage pumping chamber and the third stage pumping chamber.

11. The pump according to claim 10 further including a fourth stage pumping chamber downstream of the second stage pumping chamber and a second pressure actuated valve for controlling the flow between the third stage pumping chamber and the fourth stage pumping chamber.

12. The pump according to claim 10 wherein the first pressure actuated valve is a flap valve.

13. The pump according to claim 10 wherein either the first piston and the first cylinder or the second piston and the second cylinder are stepped so as to define the third stage pumping chamber.

14. The pump according to claim 10 wherein the spool valve is disposed between the first cylinder and the second cylinder.

15. The pump according to claim 14 wherein the spool valve comprises a passage extending between the first cylinder and the second cylinder in a lengthwise direction thereof, and further including a rod carrying a plurality of islands arranged for reciprocation in the passage, and each pumping chamber having a port leading to the passage.

16. The pump according to claim 15 wherein the first cylinder and the second cylinder and the passage are parallel.

17. The pump according to claim 15 further including a crankshaft and wherein the first piston and the second piston are adapted to be driven by the crankshaft and wherein the spool valve rod and the crankshaft are connected.

18. The pump according to claim 15 wherein the spool valve rod is adapted to reciprocate out of phase with the first piston and the second piston.

19. The pump according to claim 10 wherein the spool valve is defined to form an exhaust port of the pump and to control flow through the exhaust port.

20. A multi-stage reciprocating piston vacuum pump having a first stage, a second stage and a third stage and spool valve means arranged to control flow from the first stage to the second stage and from the second stage to the third stage.

* * * * *